US009330864B2

(12) United States Patent
Huo et al.

(10) Patent No.: US 9,330,864 B2
(45) Date of Patent: May 3, 2016

(54) PIVOTING ELECTRICAL SWITCH

(71) Applicant: Apple Inc., Cupertino, CA (US)

(72) Inventors: Edward S. Huo, San Jose, CA (US); Yaocheng Zhang, Cupertino, CA (US); Ashutosh Y. Shukla, Santa Clara, CA (US); David A. Pakula, San Francisco, CA (US); Matthew D. Hill, Santa Clara, CA (US); Michael Benjamin Wittenberg, Sunnyvale, CA (US); Scott A. Myers, Saratoga, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/542,489

(22) Filed: Nov. 14, 2014

(65) Prior Publication Data

US 2016/0071668 A1 Mar. 10, 2016

Related U.S. Application Data

(63) Continuation of application No. PCT/US2014/065777, filed on Nov. 14, 2014.

(60) Provisional application No. 62/046,624, filed on Sep. 5, 2014.

(51) Int. Cl.

| | |
|---|---|
| ***H01H 13/14*** | (2006.01) |
| ***H01H 21/04*** | (2006.01) |
| ***H01H 21/30*** | (2006.01) |

(52) U.S. Cl.

CPC ..... *H01H 21/04* (2013.01); *H01H 21/30* (2013.01); *H01H 2221/05* (2013.01); *H01H 2223/034* (2013.01); *H01H 2223/044* (2013.01)

(58) Field of Classification Search

CPC ..... H01H 13/14; H01H 13/50; B32B 3/06

USPC ..... 200/329, 513, 5 A, 541, 534, 520; 428/101

See application file for complete search history.

(56) References Cited

U.S. PATENT DOCUMENTS

| | | | | |
|---|---|---|---|---|
| 7,795,553 | B2 * | 9/2010 | Weber | H01H 13/705 200/341 |
| 2009/0000931 | A1 * | 1/2009 | Mittleman | H01H 13/48 200/341 |

(Continued)

FOREIGN PATENT DOCUMENTS

| | | |
|---|---|---|
| JP | 2007-165317 | 6/2007 |
| KR | 10-2009-003822 | 1/2009 |

OTHER PUBLICATIONS

International Search Report and Written Opinion mailed Jun. 9, 2015 for PCT Application No. PCT/US2014/065777.

*Primary Examiner* — Edwin A. Leon
*Assistant Examiner* — Iman Malakooti
(74) *Attorney, Agent, or Firm* — Downey Brand LLP

(57) ABSTRACT

The embodiments discussed herein relate to electrical switches. Specifically, the embodiments include a pivoting switch that translates a rotational movement of a portion of the pivoting switch into a linear movement for toggling a button. The pivoting switch can include a pin that extends into a bracket in order to define and limit a rotational movement of the pivoting switch. The pivoting switch can further include a switch cavity that can force a knob of the button to move with the pivoting switch. The embodiments can further include an electrical switch having a welded cover plate. The welded cover plate can include arms that extend across and are welded to one or more surfaces of the electrical switch. The welded cover plate provides a more secure retaining mechanism for the electrical switch in order to reduce bending of certain portions of the electrical switch when the electrical switch is toggled.

20 Claims, 9 Drawing Sheets

(56) References Cited

U.S. PATENT DOCUMENTS

2011/0255260 A1* 10/2011 Weber ..... H01H 9/02 361/807
2012/0043189 A1* 2/2012 Kodama ..... H01H 15/005 200/329
2012/0162940 A1* 6/2012 Qiu ..... H01H 15/10 361/752
2013/0118876 A1 5/2013 Strittmatter
2014/0001022 A1 1/2014 Weber et al.
2014/0069782 A1 3/2014 Shedletsky et al.
2014/0311882 A1* 10/2014 Terashita ..... H01H 13/10 200/520

* cited by examiner

PIVOTING ELECTRICAL SWITCH

CROSS-REFERENCE TO RELATED APPLICATIONS

This is a continuation of International Application PCT/US14/65777, with an international filing date of Nov. 14, 2014, entitled "PIVOTING ELECTRICAL SWITCH", which claims the benefit of priority under 35 U.S.C. §119(e) to U.S. Provisional Application No. 62/046,624, entitled "PIVOTING ELECTRICAL SWITCH," filed Sep. 5, 2014, the contents of which are incorporated herein by reference in their entirety for all purposes.

FIELD

The described embodiments relate generally to electrical switches. More particularly, the present embodiments relate to electrical switches that can be toggled through a pivoting motion or include a welded cover for improving structural integrity of the electrical switch.

BACKGROUND

Many mobile devices include electrical switches configured in spaces of the mobiles devices that can prove to be unsuitable for frequent toggling of the electrical switches. In some cases, the force required to toggle an electrical switch can cause certain portions of the electrical switch to bend or warp in a way that causes the electrical switch to malfunction or degrade over time. This issue can be more problematic when the electrical switch is configured to receive a toggling force that has a trajectory different than the trajectory required to toggle the electrical switch. In such scenarios, the mechanisms used to translate the toggling force into the correct toggling motion for the electrical switch can prove to be unreliable over the lifetime of the electrical switch.

SUMMARY

The embodiments discussed herein include systems, methods, and apparatus for providing a pivoting electrical switch and a welded switch cover for an electrical switch. In some embodiments, a pivot switch is set forth. The pivot switch can include a curved switch feature configured to abut a curved inner surface of a device housing. The curved switch feature can include a switch cavity at least partially surrounding a switch knob of an electrical switch. Additionally, the pivot switch can include one or more pins extending from the curved switch feature, wherein the one or more pins are at least partially disposed within one or more brackets in order to provide a limited rotation of the curved switch feature effectuate a linear movement of the switch knob.

In other embodiments, an electrical switch is set forth. The electrical switch can include a switch knob protruding from a switch surface of a body of the electrical switch. The switch knob can be configured toggle the electrical switch according to a linear sliding motion of the switch knob. The electrical switch can further include a welded cover comprising a switch aperture extending through a surface of the welded cover and defining a perimeter around the switch knob. The welded cover can further comprise one or more arms having one or more cover welds binding distal ends of the surface of the weld cover to one or more side surfaces of the body of the electrical switch.

In yet other embodiments, a computing device having a curved switch system is set forth. The curved switch system can include a curved switch surface configured to abut a curved housing surface defining a perimeter of a computing device housing of the computing device. The curved switch feature can include a pin portion and a switch cavity configured to receive a knob of a button. The curved switch system can further include a bracket configured to abut the button on a surface of the bracket that includes a bracket cavity. The bracket cavity can partially envelope the pin portion in order to define an axis of rotation for the curved switch feature and effectuate a linear movement of the knob.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1:
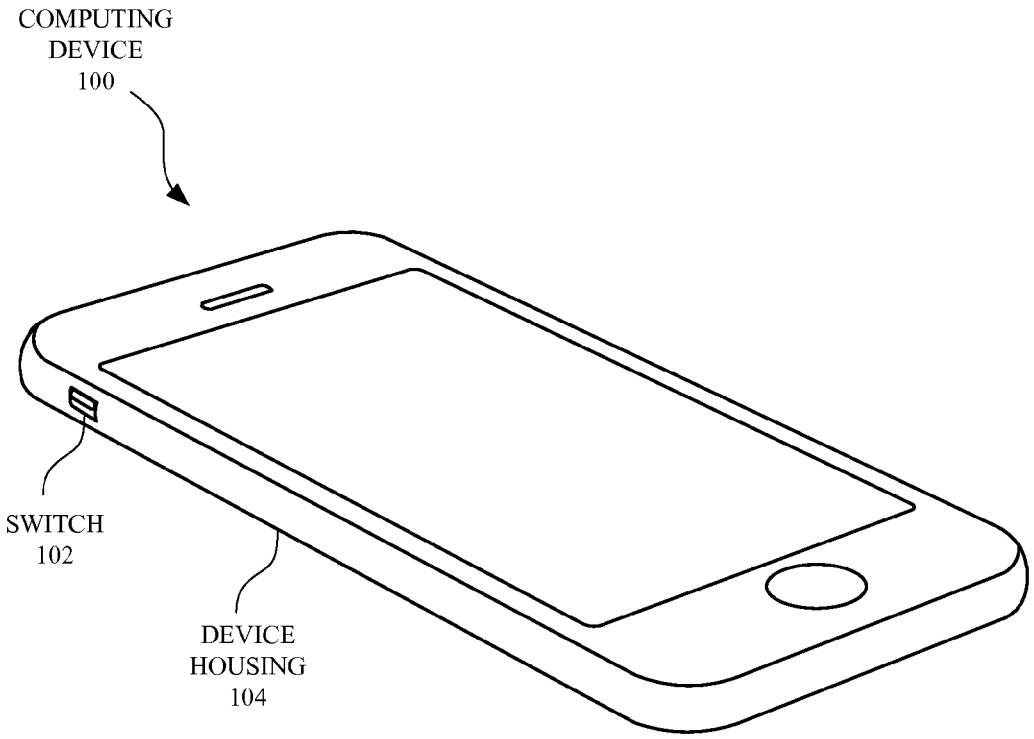
FIG. 1 illustrates a perspective view of a computing device having an electrical switch.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to device components for mobile devices. Specifically, the disclosure relates to a pivoting switch useful for providing an electronic switch at a curved surface of a mobile device. Typically, a switch that is provided along the curvature of a mobile device housing can be positioned against a curved surface inside the mobile device housing. However, in many cases the switch can rotate or become offset from an intended course for toggling the switch. This can lead to degradation of the switching function after frequently toggling the switch over time. In order to prevent such degradation, a pivoting switch is provided herein that incorporates one or more pins that are secured within a bracket allowing the pivoting switch to rotate about an axis defined by the pins and the bracket. The pivoting switch is configured to provide a user with a sensation that a rotating switch is being toggled, when actually the pivoting switch is toggling a linear switch. The linear switch can be secured to the bracket in a way that allows the movement of the pivoting switch to toggle the linear switch. To accomplish this, a switch knob of the linear switch can be disposed within a pocket or cavity of the pivoting switch allowing the pocket to force the switch knob to move with the pivoting switch. Some amount of clearance or free space can be provided between the pocket and switch knob in order to reduce the amount of friction occurring at the switch knob. However, in some embodiments, a rotating switch is used in place of the linear switch to allow a switch knob of the rotating switch to be more securely grasped by the pocket and be toggled through substantially the same motion as the rotating switch. Moreover, in some embodiments, the rotating switch and pivoting switch can be a single integral switch where no pocket is necessary because the portion that would be the pivoting switch is a single integral piece that includes a knob of a rotating switch.

Additionally, the following disclosure relates to a welded switch cover for protecting against wear caused by toggling of a switch over time. An electrical switch can typically include a switch cover that secures a switch knob and other components of the switch in place. Occasionally, the switch cover can be secured using a protruding lip that is configured to receive a latch that keeps the switch cover secured to the switch. However, over time the switch cover can become loosened by frequent toggling of the switch knob and weakening of the lip and latch. This can lead to malfunctioning of the switch and potentially loss of functionality of the mobile device in which the switch is operable. In order to provide a more secure switch cover, a welded switch cover is provided herein in order to more securely attach the switch cover to a body of the switch. The cover can be welded onto the switch body using any suitable form of welding not limited to heat staking, cold staking, insert molding, contact welding, laser welding, or some other type of bonding. The welded switch cover can cover can abut a surface of the switch and include an aperture for allowing the switch knob to protrude through and be toggled. The welded switch cover can be made from stainless steel, copper, or any suitable material that can be welded to an electrical component. A welded arm can be provided at one or more edges of the welded switch cover adjacent to the switch knob. The welded arm can include one or more apertures for receiving a bonding material to be welded to the switch body and the welded arm. In this way, a solid bond between the switch body and the arm can be provided in order to better confine the motion of the switch knob and prevent degradation of the switch as a result of frequent toggling. In some embodiments, the welded switch cover can provide protection from electrostatic discharge. For example, when the switch includes metal features configured inside of a plastic mobile device housing, the welded switch cover can ground the metal features of the switch to a common ground of the mobile device to prevent buildup of static electricity.

These and other embodiments are discussed below with reference to FIGS. 1-9. However, those skilled in the art will readily appreciate that the detailed description given herein with respect to these Figures is for explanatory purposes only and should not be construed as limiting.

FIG. 1 illustrates a perspective view of a computing device 100. The computing device 100 can include a device housing 104 having a curved perimeter and a switch 102 protruding from an aperture in the device housing 104. The switch 102 can be configured in a variety of ways in order to provide the user with a simple means of toggling a function of the computing device 100. However, depending on how the switch 102 is configured, toggling the switch 102 can be detrimental to the operation of the computing device 100 over time. For example, if the switch 102 is configured to slide against one or more curved surfaces within the device housing 104, such a configuration can lead to racking within the switch 102. Racking can occur when a portion of the switch rotates in a direction away from a toggling direction of the switch thereby causing stress to the switch 102 that can lead to a malfunctioning of the switch 102.

Figure 2A:
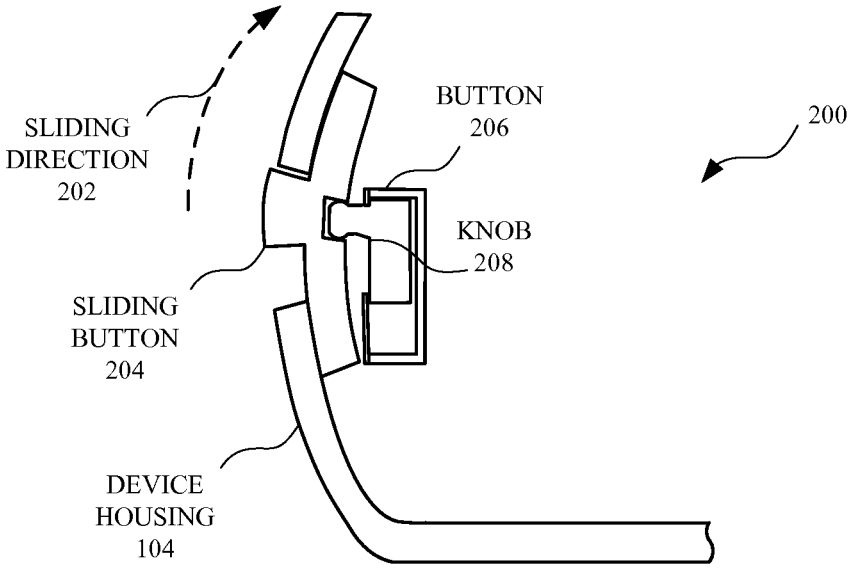
FIGS. 2A and 2B illustrate cross-sectional views of a typical sliding button.
Figure 2B:
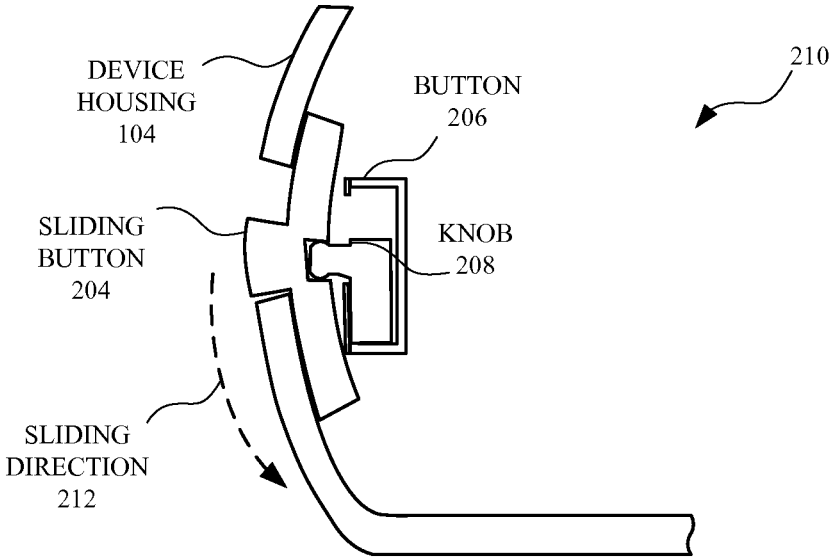

FIG. 2A illustrates a cross-sectional view 200 of a typical sliding button 204. Specifically, FIG. 2A illustrates how the sliding button 204 can move along a surface of the device housing 104 in order to toggle the button 206. When the sliding button 204 is forced to move in the sliding direction 202, the sliding button 204 forces a knob 208 of the button 206 to move linearly in substantially the same direction as the sliding direction 202. FIG. 2B illustrates a cross-sectional view 210 of the sliding button 204 moving in a sliding direction in order to toggle the button 206 in an opposite direction compared to FIG. 2A. Toggling the button 206 in this manner can lead to stress on the button 206 when the sliding button 204 moves in a direction that is away from a direction for toggling the button 206. Additionally, the knob 208 can be bent away from different sides of the button 206 leading to the malfunction of certain electrical connections within the button 206. In order to cure the deficiencies of FIGS. 2A and 2B, the pivoting switch described herein is provided.

Figure 3A:
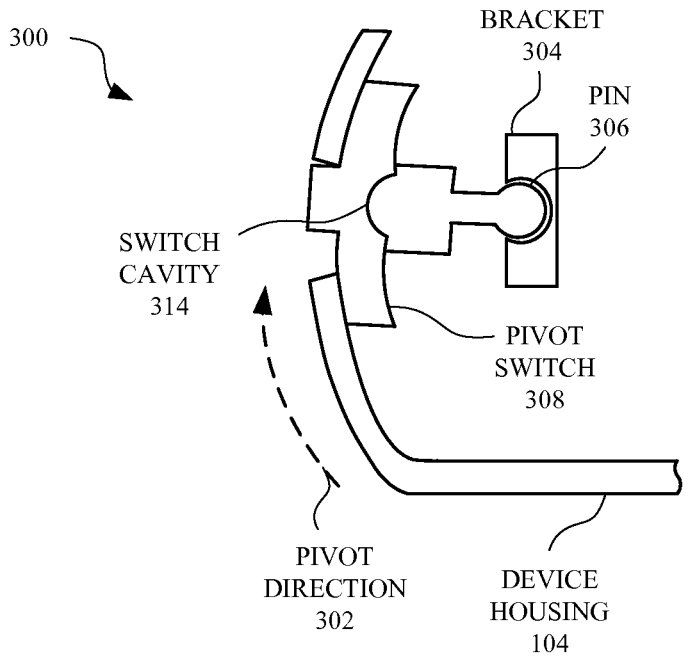
FIGS. 3A and 3B illustrate cross-sectional views of a pivot switch configured at a curved surface of a device housing.
Figure 3B:
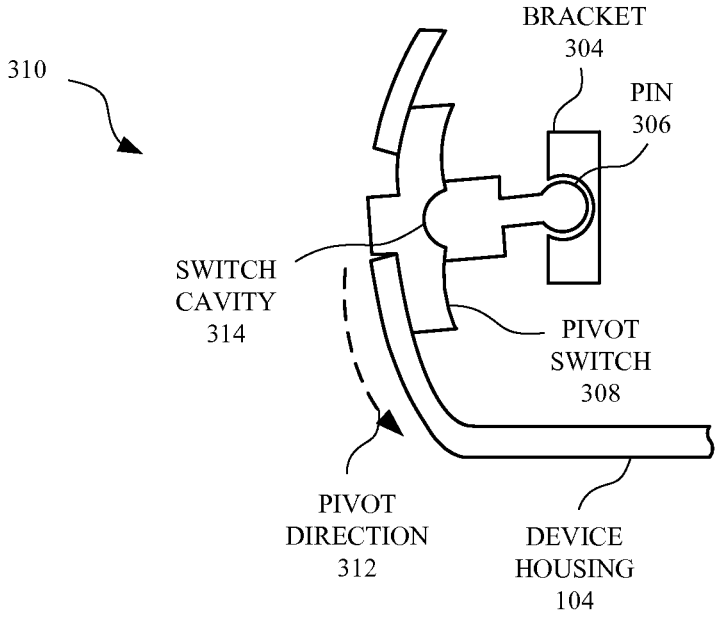

FIGS. 3A and 3B illustrate cross-sectional views 300 and 310 of the pivot switch 308 configured at a curved surface of the device housing 104. In order to detail the mechanisms by which the pivot switch 308 operates, the button 206 was not illustrated in FIGS. 3A and 3B. The pivot switch 308 operates by a sliding motion that can be performed in a pivot direction 302 and a pivot direction 312. The pivot switch 308 operates according to a rotational movement defined by the combination of a bracket 304 and a pin 306. The pin 306 can be secured within an aperture or cavity of the bracket 304 in a way that allows the pin 306 to act as an axle for the bracket 304. The pin 306 can be configured to rotate a total of at least 90 degrees in some embodiments, in order to accommodate a button that can use such a depth of motion. The pivot switch 308 can be configured to abut the device housing 104 or be offset slightly by free space or some other material in order to reduce friction between the device housing 104 and the pivot switch 308. A switch cavity 314 can be provided in the pivot switch 308 in order to receive a knob 208 of a button 206. The switch cavity 314 can be configured in a variety of sizes and shapes in order to accommodate different knob 208 sizes. Additionally, as illustrated in FIGS. 3A and 3B, the switch cavity 314 can be configured to face the pin 306 and/or the bracket 304 at least at some or all points during a pivot motion that toggles the button 206. In some embodiments, the pivot switch 308 can include one or more pins 306 that are secured to one or more brackets 304. The pins 306 can be any suitable shape in order to securely grasp or be grasped by the bracket 304. For example, the pins 306 can be ring or hook shaped in order to grasp an axle that can extend through one or more brackets 304, allowing the pivot switch 308 to rotate about the axle. Moreover, in some embodiments, the pivot switch 308 can include a flexible portion that allows toggling of a button 206 through bending and flexing of the flexible portion.

Figure 4A:
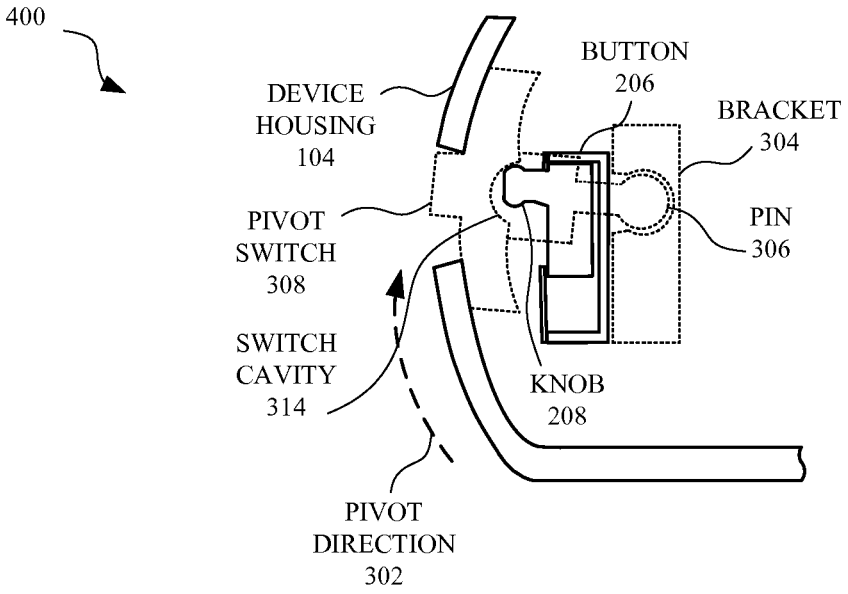
FIGS. 4A and 4B illustrate cross sectional views of the pivot switch toggling a button that is proximate to a curved surface of the device housing.
Figure 4B:
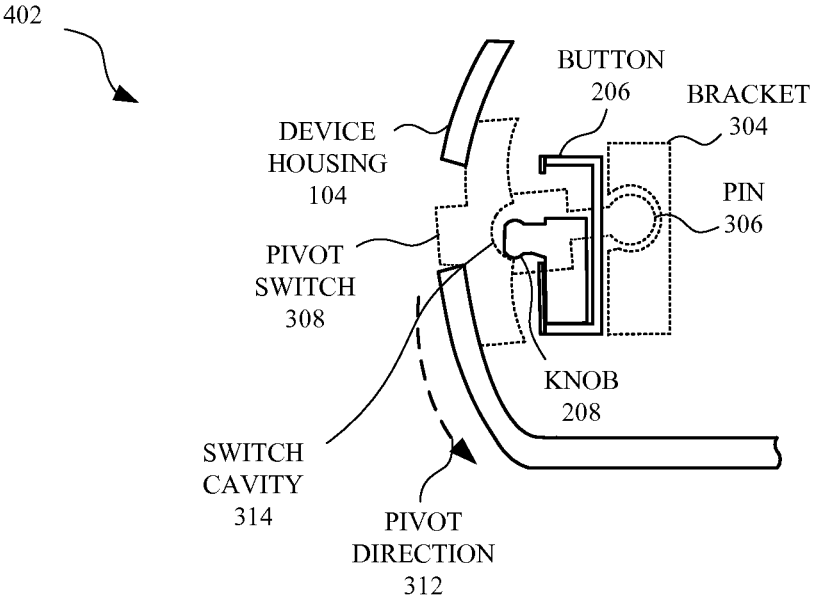

FIGS. 4A and 4B illustrate cross sectional views 400 and 402 of the pivot switch 308 toggling a button 206 that is proximate to a curved surface of the device housing 104. Specifically, FIG. 4A illustrates the knob 208 being moved in a linear direction similar to the pivot direction 302 in order to toggle the button 206. FIG. 4B illustrates the knob 208 being moved in a linear direction similar to pivot direction 312 in order to toggle the button 206 to a position different than that of FIG. 4A. The knob 208 can be at least partially enveloped by the switch cavity 314 in order to force the knob 208 to move with the pivot switch 308. Although the bracket 304 and button 206 are illustrated as floating features in the figures, it should be noted that the bracket 304 and button 206 can be secured to any suitable surface in the device housing 104. The bracket 304, pin 306, and pivot switch 308 can be made from any suitable material for providing a mechanism to toggle the button 206. Each of the bracket 304 and the button 206 can be secured to a surface in the device housing 104 in a way that causes a portion of the pivot switch 308 to at least partially protrude from an aperture in the device housing 104. Additionally, the sides of the pivot switch 308 that are adjacent to the partially protruding portion can be configured to abut a curved interior surface of the device housing 104. Moreover, the button 206 can be configured to abut at least a portion of a surface of the bracket 304 in order to provide an anchor for the button 206 when the knob 208 is being shifted by the pivot switch 308. In some embodiments, the button 206 is secured to a different surface than a surface of the bracket 304. In this way, the leverage applied to the knob 208 by the pivot switch 308 can be adjusted by modifying the proximity of the pin 306 to both the knob 208 and an end of the pivot switch 308 opposing the pin 306.

Although the pivot switch 308 is illustrated as a separate entity than the button 206 and knob 208, in some embodiments, the knob 208 is integral to the pivot switch 308. In this way, the knob 208 can be caused to move in a curved or non-linear sliding direction with the pivot switch 308. This can be especially useful when the button 206 is a rotating button that is toggled when the knob 208 is moved through a curved or non-linear sliding direction. In some embodiments, the button 206 can be a 2-way, 3-way, or N-way switch (where N is any suitable whole number) in order to provide a variety of modes that the button 206 can be toggle between. In some embodiments, the button 206 can be configured to act as a power switch, audio-off switch, vibrate-on switch, or any other suitable switch that can toggle between various device modes.

Figure 5A:
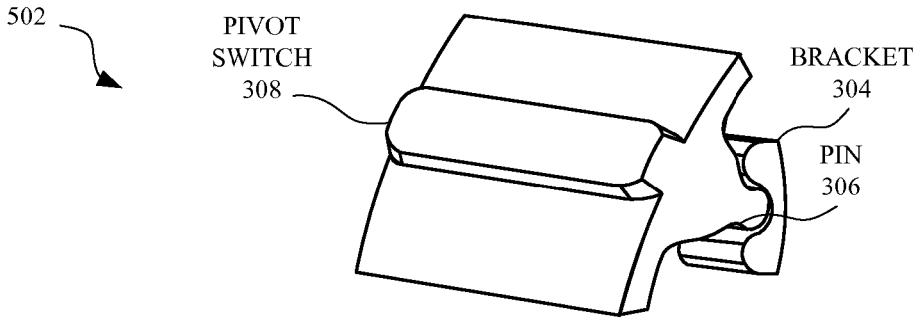
FIGS. 5A-5C illustrate views of the pivot switch according to some embodiments discussed herein.
Figure 5B:
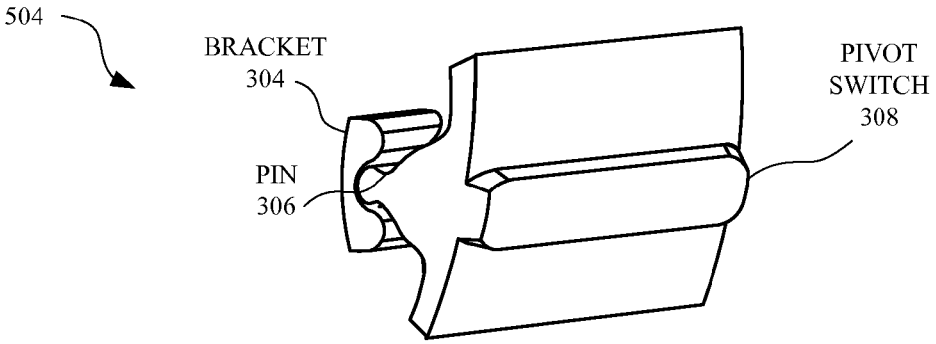
Figure 5C:
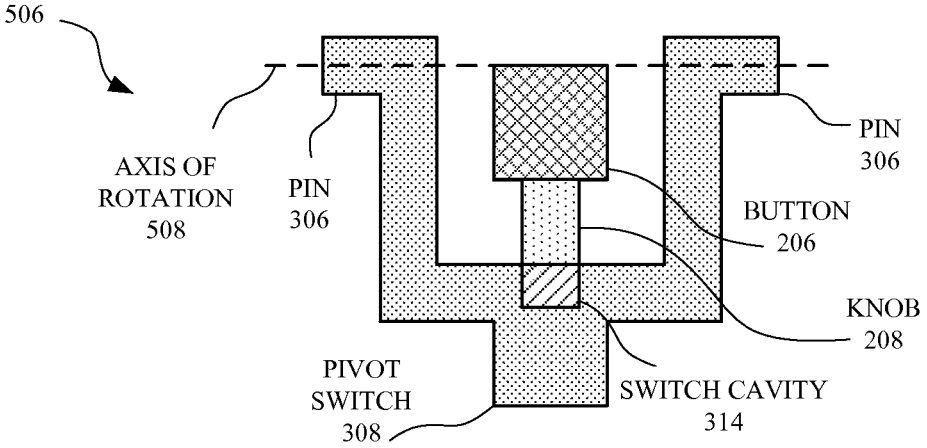

FIGS. 5A-5C illustrate views of the pivot switch 308 according to some embodiments discussed herein. Specifically, FIG. 5A illustrates a perspective view 502 of the pivot switch 308 having a pin 306 abutting the bracket 304 at a distal end of the pivot switch 308. FIG. 5B illustrates a perspective view 504 that sets forth a side of the pivot switch 308 opposing a side of the pivot switch 308 illustrates in FIG. 5A. The pivot switch 308 can include one or more pins 306 that can abut one or more portions of the bracket 304 in order to secure the pivot switch 308 between an inner surface of the device housing 104 and the bracket 304. FIG. 5C illustrates a cross-sectional view 506 of the pivot switch 308 and an axis of rotation 508 of the pivot switch 308. The axis of rotation 508 can be defined by one or more pins 306 and be parallel to a surface of the button 206. When the pivot switch 308 is rotated about the pins 306, the switch cavity 314 transfers a force to the knob 208 that moves the knob 208 in a linear direction relative to the direction of rotation of the pivot switch 308. For example, the linear direction of the knob 208 can depend on whether the pivot switch 308 is rotating clockwise or counter clockwise about the axis of rotation 508. In some embodiments, instead of a switch cavity 314, the pivot switch 308 can include a lip that protrudes toward the button 206 and can push the knob 208 in different linear directions when the pivot switch 308 is rotated about the axis of rotation 508.

Figure 6:
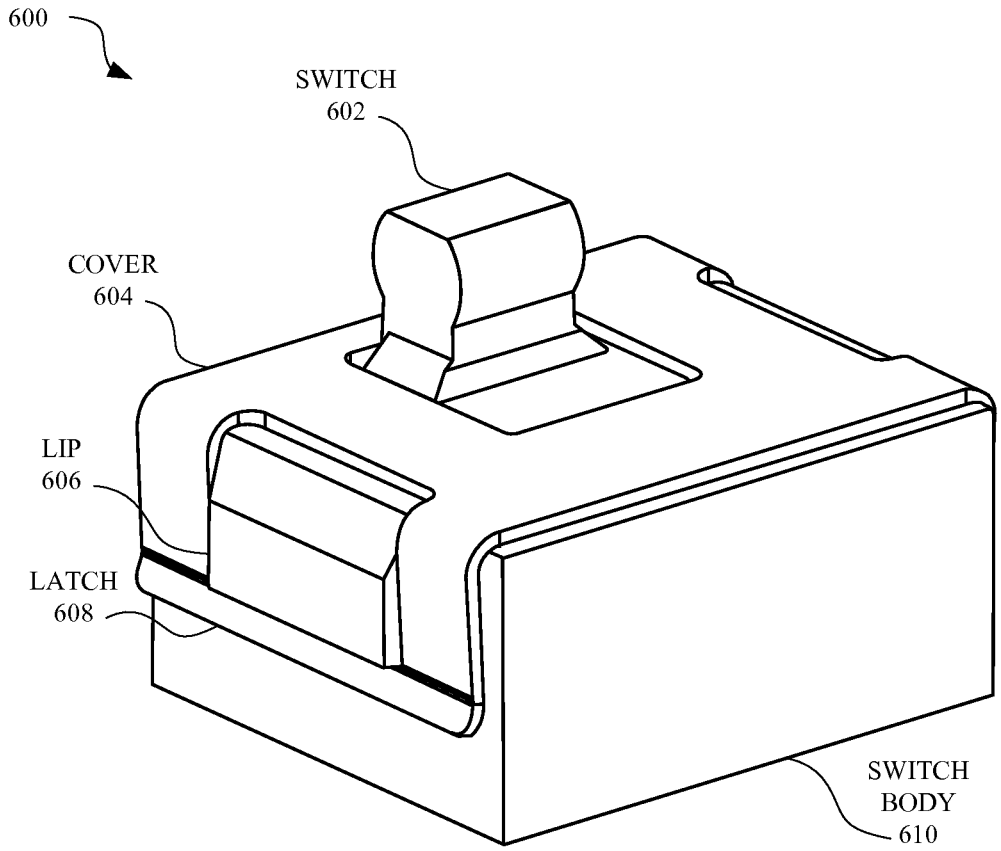
FIG. 6 illustrates a perspective view of a switch that is secured to a switch body by a cover.

FIG. 6 illustrates a perspective view 600 of a switch 602 that is secured to a switch body 610 by a cover 604. The cover 604 is secured to the switch body 610 using a latch 608. The latch 608 is configured to grip the switch body 610 on multiple sides of the switch body 610 and be held in place by a lip 606. The switch body 610 can include one or more lips 606 that protrude from one or more surfaces of the switch body 610 in order to provide a locking mechanism for the cover 604 and latch 608. However, because of the movement of the switch 602, the lip 606 can degrade over time allowing the latch 608 to become loose. As a result, the switch 602 can be displaced from the switch body 610 thereby permitting the switch 602 to move in a non-linear path that the switch 602 was not originally designed to move in. This can lead to malfunctions of the switch 602 and loss of some functionality in the mobile device that the switch 602 is operable within.

Figure 7:
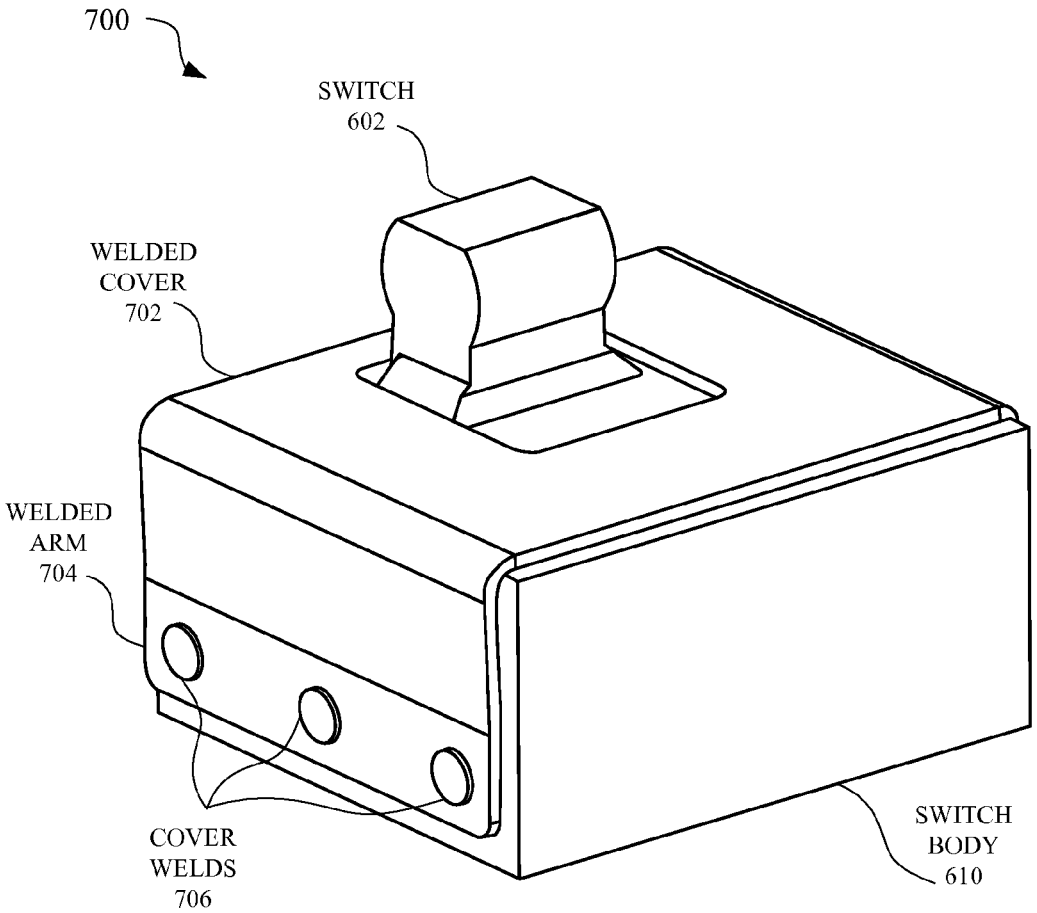
FIG. 7 illustrates a perspective view of a switch having a welded cover.

FIG. 7 illustrates a perspective view 700 of a switch 602 having a welded cover 702 that is welded, according to some embodiments discussed herein. The welded cover 702 can extend over a surface of the switch body 610 and at least partially reside on a surface of the switch 602 in order to sustain the switch 602 against the switch body 610. The welded cover 702 can include an aperture for the switch 602 to move and toggle according to a force applied by a user of a mobile device in which the switch can be operable. The welded cover 702 can include one or more welded arms 704 that extend in a direction that is substantially perpendicular to a surface of the switch body 610 on which the switch 602 resides. Additionally, in some embodiments, the welded arms 704 can extend in a direction that is parallel or non-parallel to the surface of the switch body 610 on which the switch 602 resides. In yet other embodiments, the welded arm 704 can extend at least partially across a surface of the switch body 610 that opposes the surface on which the switch 602 resides. The welded arm 704 can include one or more cover welds 706 that bind the welded arm 704 and welded cover 702 to the switch body 610. The welded cover 702 can be made from stainless steel or any suitable material for receiving a weld. The welded cover 702 can include multiple welded arms 704 that can extend onto multiple surfaces of the switch body 610 to further secure the welded cover 702 to the switch body 610. In some embodiments, the cover welds 706 are included at multiple surfaces of the switch body 610, and at least one or more of the surfaces can include multiple adjacent cover welds 706. In other embodiments, a single cover weld 706 can be used to bind the welded arm 704 to a surface of the switch body 610. The welded arm 704 can be welded to the switch body 610 using any suitable method for welding a switch cover to a switch. For example, in some embodiments, one or more welding methods such as heat staking, cold staking, laser welding, deposition, insert molding, or any other suitable binding method can be used to secure the welded arm 704 to the switch body 610. Although the cover welds 706 are illustrated as circular in FIG. 7, it should be noted that the cover welds 706 can be any suitable shape, such as elliptical or polygonal, in order to provide a secure weld for the welded cover 702.

Figure 8:
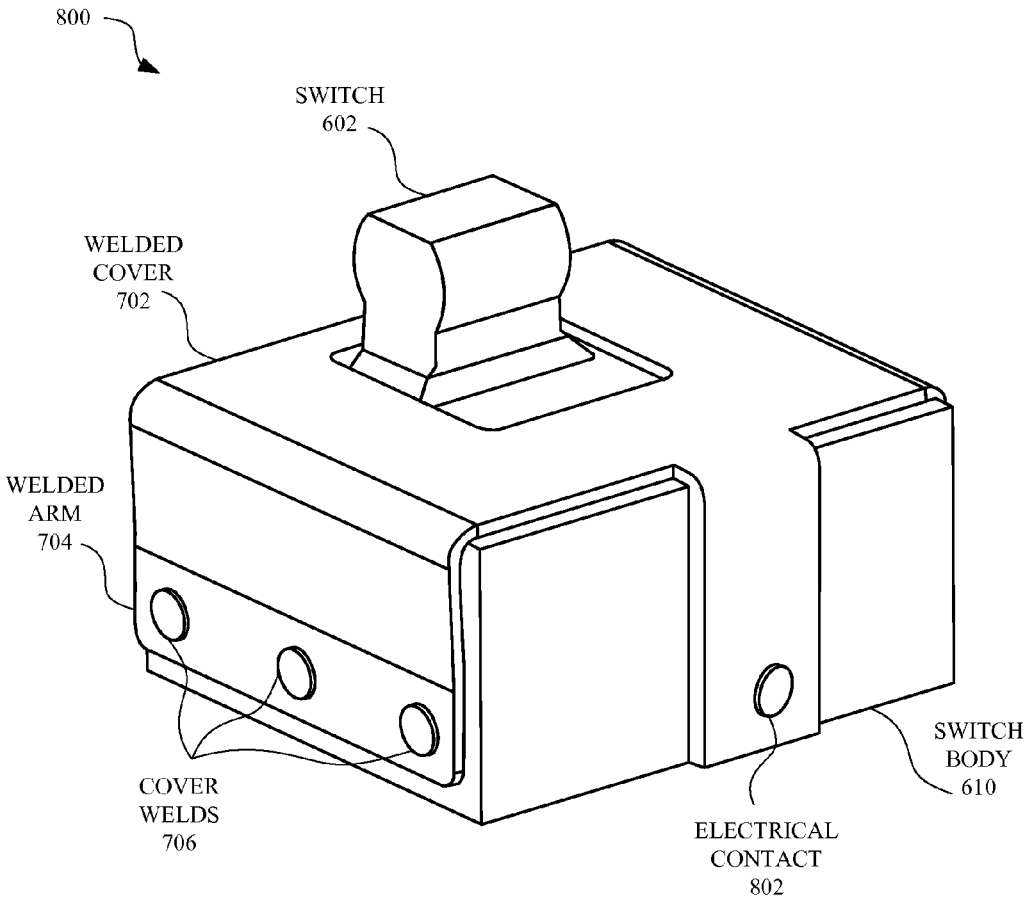
FIG. 8 illustrates a perspective view of the welded cover having an electrical contact.

FIG. 8 illustrates a perspective view 800 of the welded cover 702 having an electrical contact 802. The electrical contact 802 can provide a conductive pathway to one or more components included in the switch body 610. The electrical contact 802 can be included in a portion of the welded cover 702 that extends parallel or non-parallel to a surface of the switch body 610 that supports the switch 602. In some embodiments, the electrical contact 802 can replace one of the cover welds 706 in order to provide an electrical contact at the welded arm 704. In this way, an electrical contact 802 can be provided at multiple surfaces of the switch body 610 while the cover welds 706 can concurrently bind the welded cover 702 to the switch body 610. In some embodiments, the electrical contact 802 can be used to provide electrostatic discharge protection for the switch 602 and connect to a common ground of the mobile device in which the switch can be operable. Moreover, in some embodiments the electrical contact 802 can be provided on a surface of the switch body 610 that opposes the surface on which the switch 602 resides in order to allow the switch to be exclusively surface mounted onto an electrical connection or circuit.

Figure 9:
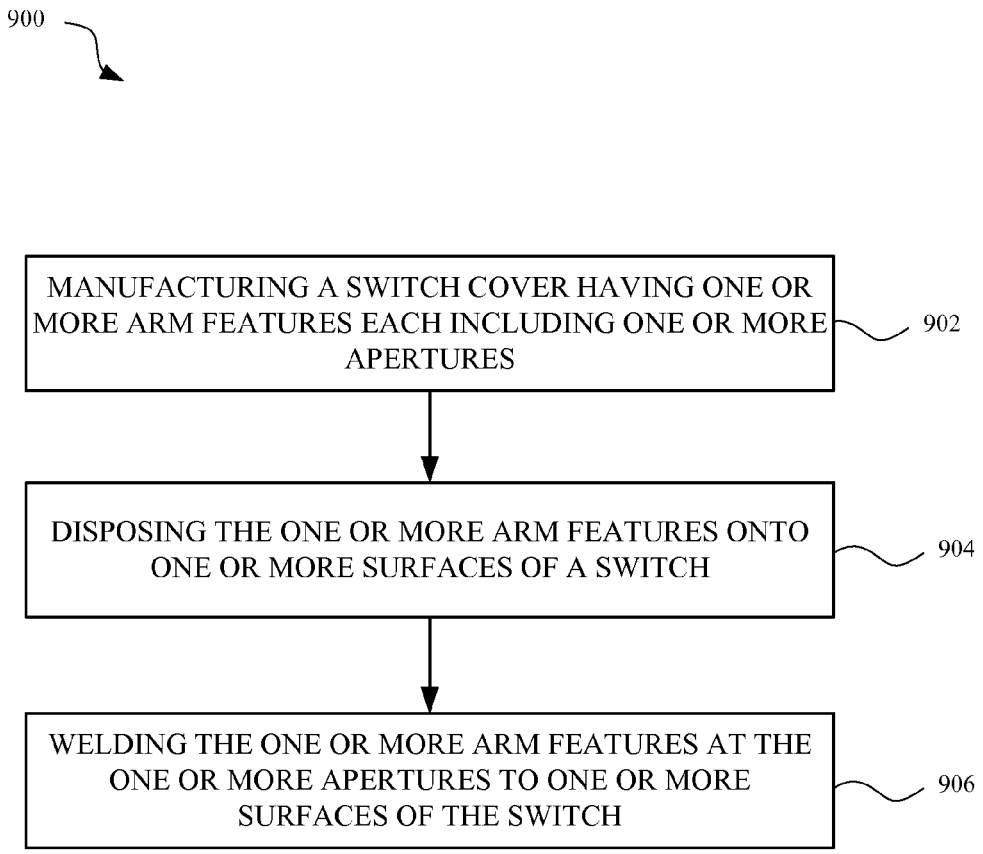
FIG. 9 illustrates a method for welding a switch cover to a switch.

FIG. 9 illustrates a method 900 for welding a switch cover to a switch. The method 900 can be performed by any suitable machine, controller, computer, or apparatus suitable for performing welding functions. The method 900 can include a step 902 of manufacturing a switch cover having one or more arm features each including one or more apertures. The apertures can define the placement of the welds, such as the cover welds illustrated in FIGS. 7 and 8. The method 900 can further include a step 904 of disposing the one or more arm features onto one or more surfaces of a switch. Thereafter, at step 906, the one or more arm features are welded at the one or more apertures to one or more surfaces of the switch. In this way, the welds can contemporaneously abut the surfaces of the switch through an aperture of the each of the arm features. Using the method 900, a more secure cover can be provided for switches having a propensity to malfunction as a result of the switch cover separating from a surface of the switch.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications, combinations, and variations are possible in view of the above teachings.

What is claimed is:

1. A pivot switch, comprising:

an electrical switch comprising a switch knob;

a curved switch feature configured to abut a curved inner surface of a device housing, wherein the curved switch feature includes a switch cavity configured to abut a first side of the switch knob when the curved switch feature is rotated in a first direction and abut a second side of the switch knob when the curved switch feature is rotated in a second direction that is opposite the first direction; and a pin extending from the curved switch feature, the pin configured to be at least partially disposed within a bracket for limiting a rotation of the curved switch feature and effectuate a linear movement of the switch knob.

2. The pivot switch as recited in claim 1, wherein the curved switch feature includes a raised portion configured to extend from an aperture in the device housing.

3. The pivot switch as recited in claim 1, wherein the bracket includes a pin cavity that is configured to partially envelope the pin.

4. The pivot switch as recited in claim 1, wherein the electrical switch abuts the bracket at a surface of the bracket that includes a pin cavity.

5. The pivot switch as recited in claim 1, wherein the switch cavity provides limited free space between the switch knob and an inner surface of the switch cavity.

6. The pivot switch as recited in claim 1, wherein the switch cavity, curved switch feature, and the switch knob are a single integral piece.

7. An electrical switch, comprising:

a switch knob protruding from a switch surface of a body of the electrical switch, wherein the switch knob is configured to toggle the electrical switch according to a linear sliding motion of the switch knob; and a welded cover comprising:

a surface comprising a switch aperture, wherein the switch knob extends through the switch aperture, and an arm comprising cover welds binding a distal end of the surface of the welded cover to a side surface of the body of the electrical switch, and an electrical contact configured to provide a conductive pathway to an electrical component inside of the body of the electrical switch.

8. The electrical switch as recited in claim 7, wherein the arm extends across a portion of the side surface perpendicular to the switch surface.

9. The electrical switch as recited in claim 7, wherein the switch knob is configured to toggle between at least two positions.

10. The electrical switch as recited in claim 7, wherein the welded cover is made of stainless steel that is welded to the side surface by a hot staking, cold staking, or laser welding method.

11. The electrical switch as recited in claim 7, wherein the arm has a width dimension that is less than a width dimension of the side surface.

12. The electrical switch as recited in claim 7, further comprising at least three individual cover welds disposed at the side surface.

13. The electrical switch as recited in claim 7, further comprising at least six individual cover welds disposed at the welded cover.

14. A computing device, comprising:

a housing; and a curved switch system disposed at least partially within the housing, the curved switch system comprising:

a sliding button comprising a knob;

a curved switch feature configured to abut a curved housing surface defining a perimeter of the housing, the curved switch feature comprising a pin portion and a switch cavity, the switch cavity configured to abut a first side of the knob when the curved switch feature is rotated in a first direction, and abut a second side of the knob opposing the first side of the knob when the curved switch feature is rotated in a second direction that is opposite of the first direction; and a bracket configured to abut the sliding button on a surface of the bracket that includes a bracket cavity, which at least partially envelopes the pin portion in order to define an axis of rotation for the curved switch feature and effectuate a linear movement of the knob.

15. The computing device as recited in claim 14, wherein the knob is configured to toggle between at least two positions.

16. The computing device as recited in claim 14, wherein the pin portion and the knob are a single integral piece.

17. The computing device as recited in claim 14, wherein the curved switch feature further includes a lip portion that protrudes from an aperture of the housing.

18. The computing device as recited in claim 14, wherein the knob extends substantially perpendicular to the bracket and toward an aperture of the computing device housing.

19. The computing device as recited in claim 14, wherein the sliding button is configured to be an audio-off switch.

20. The computing device as recited in claim 14, wherein the sliding button is configured to transition the computing device between different operating modes.

* * * * *